United States Patent [19]

Fukuo et al.

[11] Patent Number: 4,901,685

[45] Date of Patent: Feb. 20, 1990

[54] VALVE OPERATING MECHANISM FOR AN INTERNAL COMBUSTION ENGINE

[75] Inventors: Koichi Fukuo; Hiroshi Shirai; Takashi Tatsumi, all of Saitama, Japan

[73] Assignee: Honda Giken Kogyo Kabushiki Kaisha, Tokyo, Japan

[21] Appl. No.: 310,468

[22] Filed: Feb. 15, 1989

Related U.S. Application Data

[63] Continuation of Ser. No. 134,659, Dec. 18, 1987, abandoned.

[30] Foreign Application Priority Data

Dec. 19, 1986 [JP] Japan ..... 61-303156
Dec. 19, 1986 [JP] Japan ..... 61-303157

[51] Int. Cl.[4] ..... F01L 1/18
[52] U.S. Cl. ..... 123/90.16; 123/90.44
[58] Field of Search ..... 123/90.16–90.18, 123/90.27, 90.39, 90.44, 198 F

[56] References Cited

U.S. PATENT DOCUMENTS

| | | | |
|---|---|---|---|
| 4,253,434 | 3/1981 | Takizawa et al. | 123/90.16 X |
| 4,354,460 | 10/1982 | Mae et al. | 123/90.16 |
| 4,534,323 | 8/1985 | Kato et al. | 123/90.16 |
| 4,535,732 | 8/1985 | Nakano et al. | 123/90.16 |
| 4,537,165 | 8/1985 | Honda et al. | 123/90.16 |
| 4,545,342 | 10/1985 | Nakano et al. | 123/198 F |

*Primary Examiner*—Willis R. Wolfe
*Attorney, Agent, or Firm*—Lyon & Lyon

[57] ABSTRACT

A valve operating mechanism for an internal combustion engine having a crankshaft and a plurality of intake or exhaust valves normally biased in a valve closing direction includes a rocker shaft, a cam rotatable in synchronism with the crankshaft, a plurality of rocker arms swingably supported on the rocker shaft in association with the valves, respectively, and swingable by the cam, a coupling device for selectively connecting and disconnecting adjacent ones of the rocker arms under hydraulic pressure, and a hydraulic circuit openable and closable according to a rotational speed of the engine for selectively supplying hydraulic pressure to the coupling device. The opening and closing of the hydraulic circuit are controlled in view of a delay in operation thereof based on an angular displacement of the crankshaft or the cam so that the coupling device will be inoperative when the rocker arms are in a predetermined initial interval of a valve opening stroke thereof. The delay in operation of the hydraulic circuit is determined dependent on operating conditions of the internal combustion engine. The predetermined initial interval is defined such that when a piston of the coupling device is urged to slidably move from one of the rocker arms to the other during the initial interval, the piston is struck by the other rocker arm.

7 Claims, 7 Drawing Sheets

VALVE OPERATING MECHANISM FOR AN INTERNAL COMBUSTION ENGINE

This application is a continuation, of application Ser. No. 134,659, filed 12/18/87, now abandoned.

BACKGROUND OF THE INVENTION

The present invention relates to a method of and a system for controlling a valve operating mechanism for an internal combustion engine having a plurality of intake or exhaust valves openable and closable by rocker arms angularly movable by cams rotatable in synchronism with the crankshaft of the engine.

There is known a valve disabling mechanism in an internal combustion engine for changing the number of intake and exhaust valves in operation dependent on the rotational speed of the engine for thereby optimizing intake and exhaust efficiencies throughout the entire engine speed range from low to high speeds (see Japanese Laid-Open Patent Publication No. 61-31614). Japanese Laid-Open Patent Publication No. 61-19911, filed by the same assignee as the assignee of the present application, has proposed a method of increasing the efficiency of charging an air-fuel mixture into a combustion chamber in a wide engine operating range by varying the timing of operation of valves differently in low and high engine speed ranges.

In the known arrangements, a solenoid-operated valve is actuated dependent on the rotational speed of the engine to open or close a hydraulic circuit for moving a piston disposed in one rocker arm to connect or disconnect the rocker arm to or from an adjacent rocker arm, so that the rocker arms can be operated in unison with or separately from each other. To allow the piston to move smoothly, it is necessary that the adjacent rocker arms be held at rest, i.e., held in sliding contact with base-circle portions of respective cams when the piston is moved.

Generally, after a control signal is applied to the solenoid-operated valve to shift its spool for opening the hydraulic circuit when the rotational speed of the engine reaches a preset speed, a considerable delay is experienced, dependent on the oil pressure and oil temperature, before the piston is actually operated. Moreover, while the adjacent rocker arm is swinging in a direction to open the associated valve, the piston cannot easily be extended into the adjacent rocker arm. It will be apparent, therefore, that during the initial stage of the valve opening cycle, even if the piston is successful in entering the bore in the adjacent rocker arm slightly, the piston will be released from, or struck, by the rocker arm before it completely enters the bore to effect full engagement, thus producing noise or being damaged. On the other hand, the connected rocker arms while they are in swinging motion cannot reliably be released from each other because of frictional engagement between the piston and the bores in the respective rocker arms. Therefore, it is apparent from the above that the rocker arms may not smoothly be coupled to, and released from, each other dependent on the particular timing of operation of the piston.

According to the valve disabling mechanism shown in Japanese Laid-Open Patent Publication No. 61-31614, the piston which is extendable and retractable is normally urged by a spring housed therein in a direction to extend, the piston and a timing plate is provided which is engageable with the piston for controlling the timing of operation of the piston. This mechanism is however structurally complex and highly expensive. Therefore, where such mechanism is to be combined with each of the sets of the rocker arms for all engine cylinders, the cost of manufacture becomes very high.

Another method would be to control the opening and closing of the hydraulic circuit for moving the piston such that it occurs during periods except those in which it would be struck by the rocker arm, in view of the delay in operation caused by the hydraulic circuit, even if the engine rotational speed has already reached the preset speed. One problem with this method, however, is that in a multicylinder engine, pistons of the valve operating mechanism would be struck by rocker arms at different times for respective engine cylinders. Since such different times come one after another as the crankshaft or cams rotate, the piston will necessarily be struck with respect to a certain engine cylinder.

SUMMARY OF THE INVENTION

It is an object of the present invention to provide a method of controlling a valve operating mechainsm for an internal combustion engine to allow rocker arms to be smoothly connected to and disconnected from each other at all times regardless of a delay in operation caused by a hydraulic circuit.

Another object of the present invention is to provide a system for controlling a valve operating mechainsm for an internal combustion engine to allow rocker arms to be smoothly connected to and disconnected from each other at all times.

According to the present invention, there is provided a method of controlling a valve operating mechanism for an internal combustion engine having a crankshaft and a plurality of intake or exhaust valves normally biased in a valve closing direction, the valve operating mechanism having a rocker shaft, a cam rotatable in synchronism with the crankshaft, a plurality of rocker arms swingably supported on the rocker shaft in association with the valves, respectively, and swingable by the cam, coupling means for selectively connecting and disconnecting adjacent ones of the rocker arms under hydraulic pressure, and a hydraulic circuit openable and closable according to a rotational speed of the engine for selectively supplying hydraulic pressure to the coupling means, the method comprising the step of controlling the opening and closing of the hydraulic circuit in view of a delay in operation thereof based on an angular displacement of the crankshaft or the cam so that the coupling means will be inoperative when the rocker arms are in a predetermined initial interval of a valve opening stroke thereof.

According to the present invention, there is also provided a system for controlling a valve operating mechanism for an internal combustion engine having a crankshaft, a plurality of cylinders, and a plurality of intake or exhaust valves associated with each of the cylinders and normally biased in a valve closing direction, the valve operating mechanism having a rocker shaft, a cam rotatable in synchronism with the crankshaft, a plurality of rocker arms swingably supported on the rocker shaft in association with the valves, respectively, and swingable by the cam, coupling means associated with each of the cylinders for selectively connecting and disconnecting adjacent ones of the rocker arms under hydraulic pressure, and a hydraulic circuit openable and closable according to a rotational speed of the engine for selectively supplying hydraulic pressure to the coupling means, the device comprising means for opening and closing the hydraulic circuit at fixed times dependent on the stroke of one of the cylinders, and control means associated with said one of the cylinders for controlling the timing of operation of the coupling means associated with said one cylinder in view of a delay in operation of the hydraulic circuit so that the coupling means will be inoperative when the rocker arms are in a predetermined initial interval of a valve opening stroke thereof.

The coupling means includes an axially extendable and retractable piston slidably movable in and between the rocker arms for selectively connecting and disconnecting the rocker arms, and spring means disposed in the piston for normally urging the piston in a direction to extend the control means having a timing plate for controlling movement of the piston by selectively engaging and disengaging the piston.

The delay in operation of the hydraulic circuit is determined dependent on operating conditions of the internal combustion engine.

The rocker arms have first and second guide holes defined respectively therein, the coupling means including a piston slidably movable between the first and second guide holes for selectively connecting and disconnecting the rocker arms. The predetermined initial interval is defined as being that during which the piston if urged to slidably move from the first guide hole into the second guide hole would be struck by the rocker arm having the second guide hole.

With the aforesaid arrangement, the coupling means is operated to connect or disconnect the rocker arms while the rocker arms are at rest or angularly moved in a valve opening direction; except during the initial interval of the valve opening stroke when the piston of the coupling means would be struck by one of the rocker arms. The piston of the coupling means is therefore not struck by the rocker arms during operation thereof with respect to all of the cylinders of the engine. Since the control means is associated with only one of the engine cylinders, the overall device is easy to construct, and inexpensive to manufacture.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
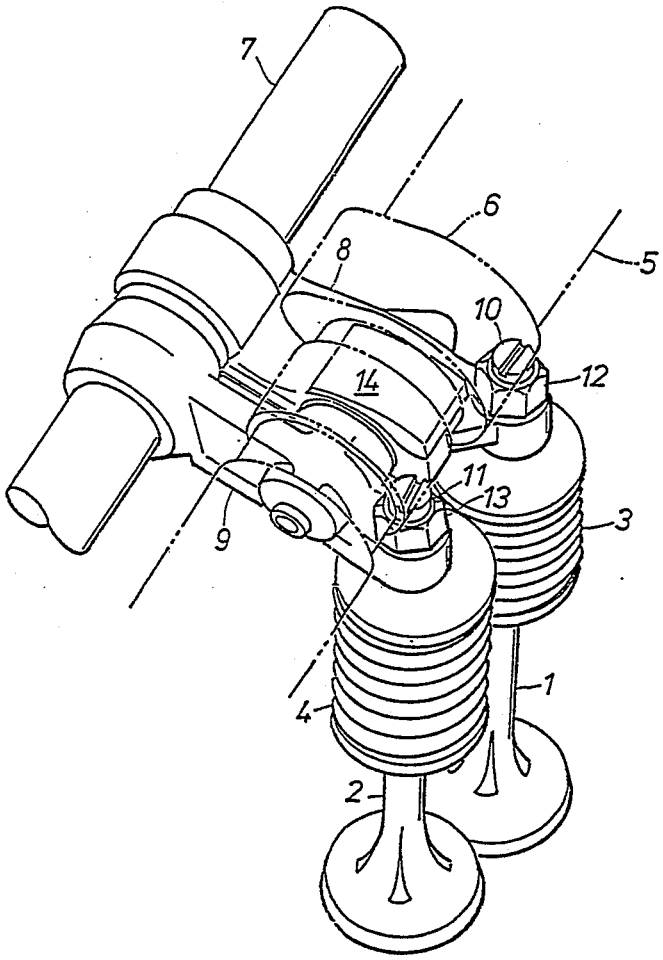
FIG. 1 is a fragmentary perspective view of a valve operating mechanism according to an embodiment of the present invention.

As shown in FIG. 1, an internal combustion engine body (not shown) has a pair of intake valves 1, 2 which are normally urged in a closing direction by respective springs 3, 4. The intake valves 1, 2 can be opened and closed by the coaction of a cam 6 which is of egg-shaped cross section and is integrally formed on a camshaft 5 synchronously rotatable at a speed ratio of ½ with respect to the speed of rotation of a crankshaft (not shown), and first and second rocker arms 8, 9 swingably supported on a rocker shaft 7 parallel to the camshaft 5. The internal combustion engine also has a pair of exhaust valves (not shown) which can be opened and closed in the same manner as the intake valves 1, 2.

The rocker arms 8, 9 are disposed adjacent to each other. Tappet screws 10, 11 are adjustably threaded through the free ends of the rocker arms 8, 9 extending over the intake valves 1, 2 and are held against the upper ends of the intake valves 1, 2. The tappet screws 10, 11 are locked against being loosened by means of lock nuts 12, 13, respectively. A cam slipper 14 is formed on the upper surface of the first rocker arm 8 in slidable contact with the cam 6.

Figure 2:
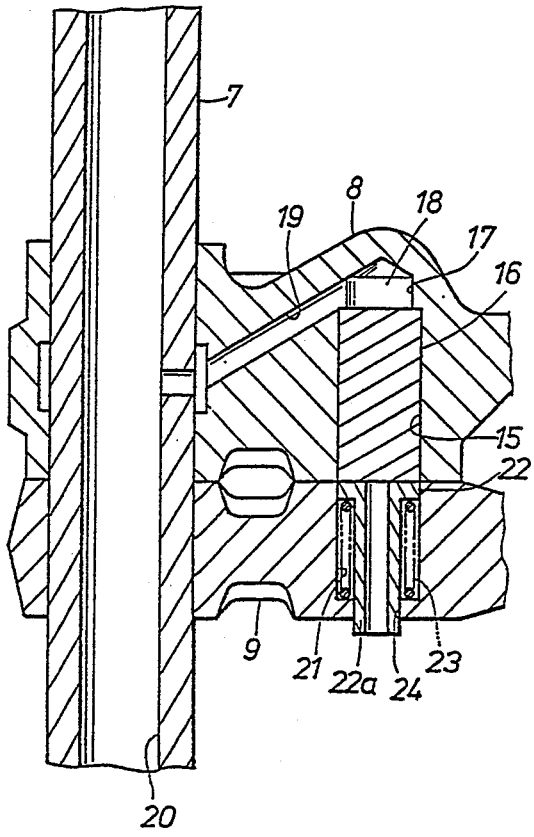
FIG. 2 is a horizontal cross-sectional view of a coupling device in the valve operating mechanism shown in FIG. 1.

As shown in FIG. 2, the first and second rocker arms 8, 9 can be selectively connected to and disconnected from each other by a coupling device. More specifically, the first rocker arm 8 has defined therein a first guide hole 15 opening toward the second rocker arm 9 and extending parallel to the rocker shaft 7. A piston 16 is axially slidably disposed in the first guide hole 15. The first rocker arm 8 also has a smaller-diameter hole 17 near the closed end of the first guide hole 15, the hole 17 defining a hydraulic chamber 18. The hydraulic chamber 18 is kept in communication with an oil passage 20 defined in the rocker shaft 7 through a passage 19 no matter how the first rocker arm 8 may be angularly positioned. The oil passage 20 communicates with an oil pump through a solenoid-operated valve. The second rocker arm 9 has defined therein a second guide hole 21 communicating with the first guide hole 15 in the first rocker arm 8. A stopper 22 is disposed in the second guide hole 21 and normally urged toward the first rocker arm 8 under the bias of a coil spring 23. The stopper 22 includes a central guide rod **22*a* projecting out through a through hole 24 defined in the bottom of the second guide hole 21**.

In medium and low speed ranges of the engine, no oil pressure is supplied to the hydraulic chamber 18, and the piston 16 is positioned within the first guide hole 15. Therefore, the rocker arms 8, 9 are not connected to each other and are angularly displaceable with respect to each other. At this time, since the cam slipper 14 which is formed only on the first rocker arm 8 is slidingly held against the cam 6, only the first rocker arm 8 is caused to swing in response to rotation of the camshaft 5, and hence only the intake valve 1 is opened.

Figure 3:
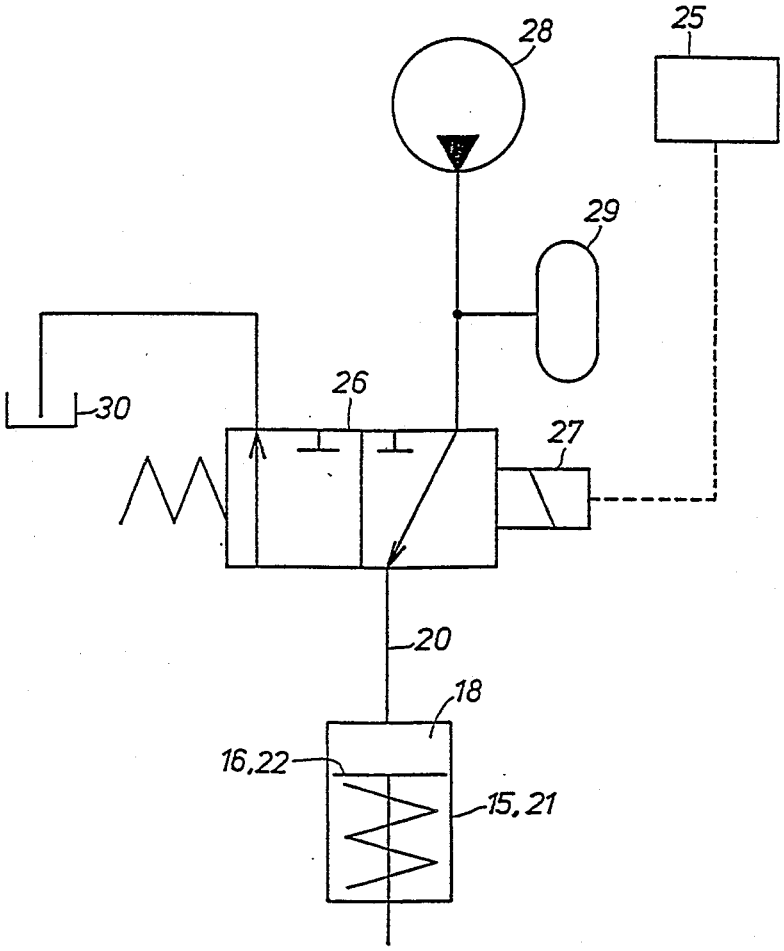
FIG. 3 is a circuit diagram of a hydraulic circuit for operating the coupling device illustrated in FIG. 2.

When the engine operates in a high speed range, the pressure of working oil is supplied to the hydraulic chamber 18. More specifically, as shown in FIG. 3, when the rotational speed of the engine reaches a preset engine speed, a solenoid 27 of a solenoid-operated valve 26 is energized by a control unit 25 to open a hydraulic circuit extending from an oil pump 28 via the oil passage 20 to the hydraulic chamber 18. As shown in FIG. 2, the piston 16 is now pushed toward the secondrrocker arm 9 and moved into the second guide hole 21 while pressing the stopper 22 against the bias of the coil spring 23. The first and second rocker arms 8, 9 are thus interconnected by the piston 16. As shown in FIG. 3, an accumulator 29 is connected to the hydraulic circuit upstream of the solenoid-operated valve 26 for adding the pressure of accumulated oil to the oil pressure supplied from the oil pump 28. Therefore, the response of the piston 16 as it moves under oil pressure is increased.

When the engine speed drops below the preset speed after the first and second rocker arms 8, 9 have been connected to each other, the solenoid 27 is de-energized to cause the solenoid-operated valve 26 to close the hydraulic circuit between the oil pump 28 and the hydraulic chamber 18. The oil pressure which has acted on the piston 16 is released from the hydraulic chamber 18 via the oil passage 20 into an oil tank 30. The piston 16 is forced by the spring 23 to move back into the guide hole 15 of the first rocker arm 8. Therefore, the first and second rocker arms 8, 9 are disconnected from each other, and the second rocker arm 9 is held at rest or disabled again.

The timing for operating the intake valve 2 in unison with the intake valve 1 will be described with reference to FIG. 4.

Figure 4:
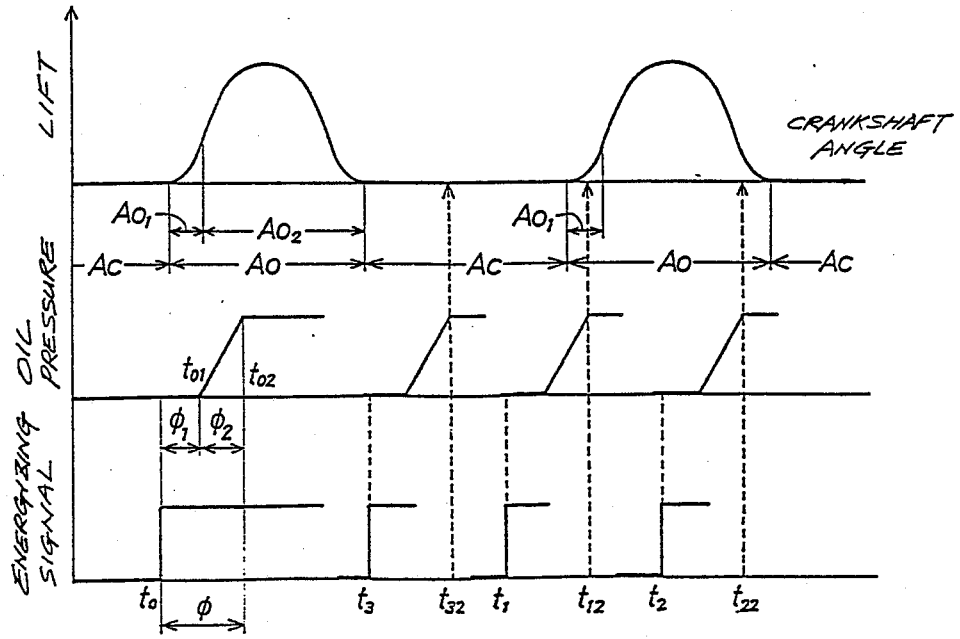
FIG. 4 is a diagram showing the timing of operation of a valve.

The graph of FIG. 4 has a horizontal axis representing the crankshaft angle or angular displacement of the crankshaft, and a vertical axis indicating the lift of the intake valve 1, the oil pressure acting in the hydraulic chamber 18, and an energizing signal applied to the solenoid 27. During a valve opening interval Ao of the intake valve 1, since the first rocker arm 8 is in swinging motion, the piston 16 cannot engage or be released from the second rocker arm 9. During an interval Ac when the valve is closed, the first rocker arm 8 is held at rest as the cam slipper 14 thereof slidingly contacts the base-circle portion of the cam 6, and the first and second guide holes 15, 21 are kept in axial registry with each other. Therefore, the piston 16 can smoothly be moved into the second guide hole 21 for reliably connecting or disconnecting the first and second rocker arms 8, 9.

During an initial interval $Ao_1$ after the first rocker arm 8 has started to open, the valve 1, the first rocker arm 8 is angularly displaced only slightly with respect to the second rocker arm 9. The piston 16, when pushed, is moved toward the second rocker arm 9 and slightly engages the second rocker arm 9. Since the first rocker arm 8 continuously swings in the valve opening direction, the piston 16 is struck by the second rocker arm 9 out of engagement with the opening 21, thereby producing noise or being damaged. Accordingly, it is not preferred to urge the piston 16 toward the second rocker arm 9 during the initial interval of the valve opening motion of the first rocker arm 8. During an interval $Ao_2$ after the initial interval $Ao_1$, the first rocker arm 8 is considerably angularly displaced with respect to the second rocker arm 9, and hence the piston 16, even if pushed under oil pressure, cannot engage the opening 21 in the second rocker arm 9, but only abuts against the confronting surface of the second rocker arm 9. Then, at the same time that the valve closing interval Ac is initiated in which the first rocker arm 8 is held at rest and the first and second guide holes 15, 21 are in mutual axial registry, the piston 16 starts moving into the second guide hole 21 of the second rocker arm 9. It can be understood from the above analysis that the piston 16 may be urged toward the second rocker arm 9 anytime except during the interval $Ao_1$.

In general, there is a certain delay before the oil pressure supplied to the hydraulic chamber 18 reaches a certain operating pressure after an energizing signal is applied to the solenoid-operated valve 26. When an energizing signal is issued from the control unit 25 at a time t0, the solenoid-operated valve 26 is actuated to open the hydraulic circuit from the oil pump 28. Then, a delay 1 is experienced before oil pressure is actually supplied at a time $t_{01}$, and another delay $\phi_2$ is caused before the oil pressure reaches a desired pressure level. Therefore, there is a total delay $\phi=\phi_1+\phi_2$ from the time $t_0$ when the energizing signal is generated to a time $t_{02}$ when the piston starts moving.

If an energizing signal is applied at a time $t_1$ in FIG. 4, a time $t_{12}$ when the pressure of working oil is applied to the hydraulic chamber 18 to move the piston 16 is in the interval $Ao_1$, and hence the piston 16 is struck by the second rocker arm 9 and cannot be moved smoothly. If an energizing signal is applied at a time $t_2$ during the interval $Ao_2$ which is contained in a valve opening interval Ao but in which the piston 16 is not struck, a time $t_{22}$ when the piston 16 starts moving is contained in the valve opening interval of the first rocker arm 8, and the piston 16 is urged smoothly toward the second rocker arm 9 without being struck thereby. If an energizing signal is applied at a time $t_3$ when the first rocker arm 8 is held at rest, a time $t_{32}$ when the piston 16 starts moving is contained in the valve closing interval Ac, and hence the piston 16 can smoothly and reliably engage the second rocker arm 9. As described above, in order to prevent the piston 16 from being struck by the second rocker shaft 9, energizing signals should be issued from the control unit 25 by taking operation delays into consideration.

The oil supplied to the hydraulic chamber 18 is lubricating oil drawn by the oil pump which is operated by part of the power generated by the engine. Therefore, the aforesaid delays in operation may somewhat be varied dependent on the operating conditions of the engine. Therefore, the times at which energizing signals are to be issued for supplying the oil pressure to the hydraulic chamber 18 should be determined in view of various factors such as the engine rotational speed, the oil temperature, the oil pressure, and the battery voltage. The interval $Ao_1$ in which the piston will be struck should be selected to be slightly wider also in view of the above factors. The piston is less liable to be struck by the second rocker arm by producing energizing signals while thus adjusting the operation delays dependent on the engine operating conditions.

The timing for getting the intake valve 2 into operation with the intake valve 1 may be determined on the basis of the camshaft angle or angular displacement of the camshaft, rather than the crankshaft angle as illustrated.

Figure 5:
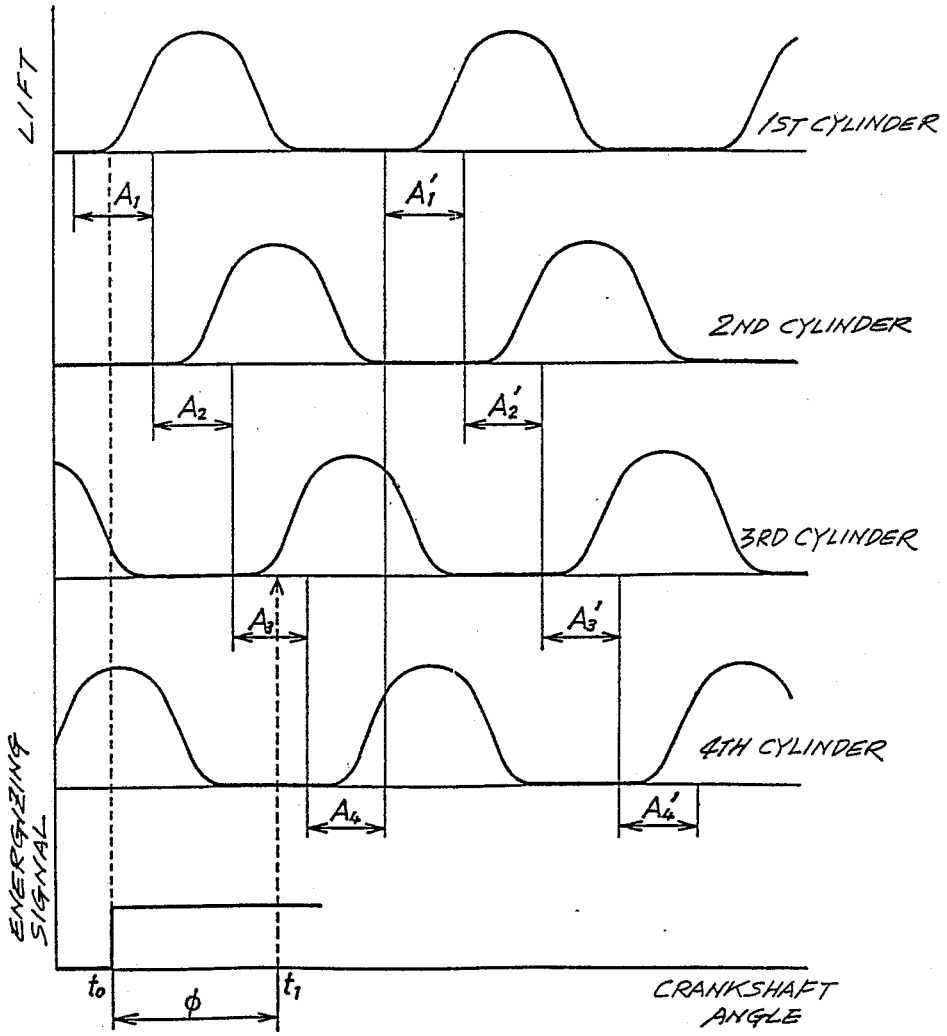
FIG. 5 is a diagram showing the timing of operation of valves associated with different engine cylinders.

FIG. 5 shows a graph representing the lifts of intake valves of first through fourth cylinders of a four-cylinder internal combustion engine, as plotted against the crankshaft angle. For the first cylinder, the valve opening motion of the first rocker arm has an initial interval Al in which the piston 16 is struck by the second rocker arm. The interval Al is selected to be relatively wide in view of the engine rotational speed, the oil temperature, the oil pressure, and the battery voltage, as described above. Such initial intervals $A_1$ through $A_4$ are successively present for the respective cylinders in a series of intake strokes, and initial intervals $A'_1$through $A'_4$ are successively present for the respective cylinders in a next series of intake strokes. If energizing signals to be applied to solenoid-operated valves were produced randomly from the control unit 25, then the piston 16 would be struck by the second rocker arm for any one of the cylinders.

More specifically, it is assumed that an energizing signal is issued at a fixed time $t_0$ when the piston in a certain cylinder, e.g., the first cylinder reaches its top dead center irrespective of the time at which the engine rotational speed reaches a preset speed. Then, the piston 16 of the coupling device for each cylinder starts moving at a time $t_1$ because of the operation delay. Since the time $t_1$ is in the intial interval $A_3$ for the third cylinder, the piston 16 of the coupling device for the third cylinder is necessarily struck by the second rocker arm.

Therefore, control means should be provided for controlling the timing of operation of the coupling device for the rocker arms for the third cylinder. Such control means is disclosed in Japanese Laid-Open Patent Publication No. 61-31614 filed by the same assignee as that of the present application.

Figure 6:
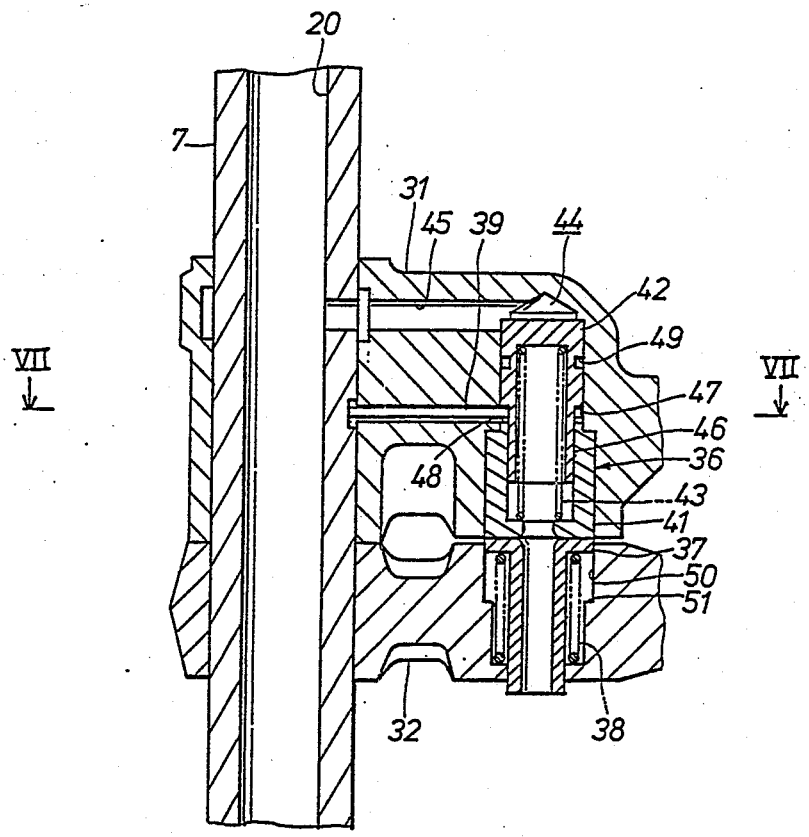
FIG. 6 is a horizontal cross-sectional view of a coupling device having control means.

The control means will be described in detail with reference to FIGS. 6 and 7.

On a rocker shaft 7, there are swingably supported a first rocker arm 31 and a second rocker arm 32 which are held in slidable contact with each other and displaceable with respect to each other. The first rocker arm 31 is swingable to open an intake valve 35 in response to rotation of a cam 34 slidably held against a cam slipper 33 of the first rocker arm 31. A coupling device for selectively connecting and disconnecting the first and second rocker arms 31, 32 includes a piston 36 movable between the first and second rocker arms 31, 32, a stopper 37 for limiting the movement of the piston 36, a coil spring 38 for normally urging the stopper 37 toward the first rocker arm 31, and a timing plate 39 for controlling the timing of movement of the piston 36.

The piston 36 is slidably disposed in a first guide hole 40 defined in the first rocker arm 31, and comprises a cylindrical connector 41 and a bottomed cylindrical presser 42. The connector 41 and the presser 42 are axially movable toward and away from each other and are normally urged away from each other by a coil spring 43 disposed therein. A hydraulic chamber 44 is defined in the bottom of the first guide hole 40 and communicates with an oil passage 20 defined in the rocker shaft 7 through an oil passage 45. The presser 42 has a smaller-diameter tubular portion 46 with a step 47 on one end thereof. The step 47 and the end of the connector 41 jointly define an annular groove 48 therebetween in which the timing plate 39 can engage. The presser 42 also has another annular groove 49 defined in an outer peripheral surface. When the presser 42 is displaced a maximum stroke toward the second rocker arm 32 to fully interconnect the first and second rocker arms 31, 32, the timing plate 39 can engage in the annular groove 49.

The second rocker arm 32 has a second guide hole 50 defined therein and opening toward the first guide hole 40. The stopper 37 of a disc shape is slidably disposed in the second guide hole 50, the stopper 37 being movable into the second guide hole 50 until it abuts against a step 51.

Figure 7:
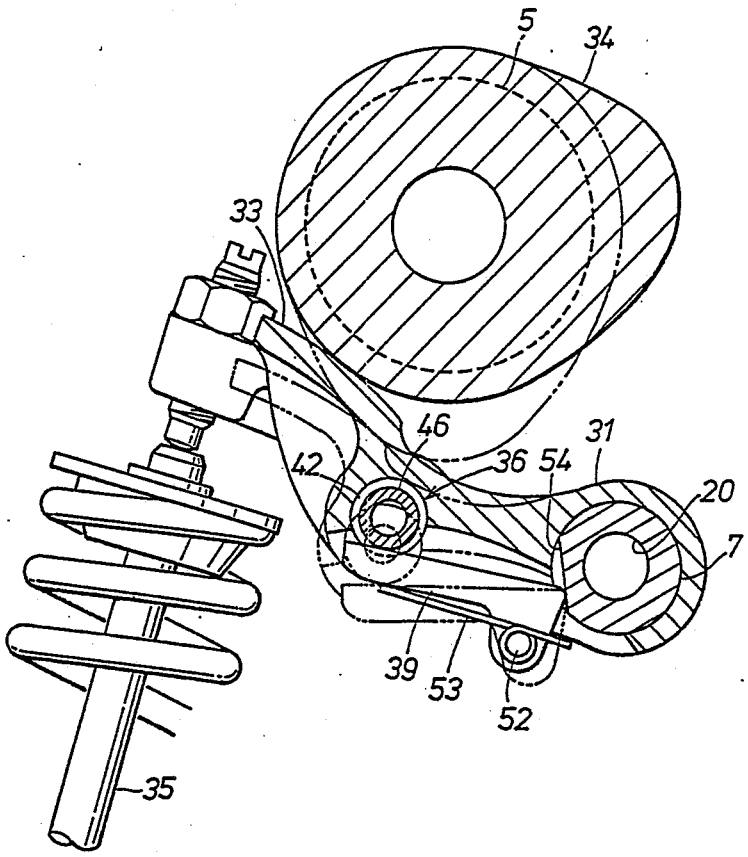
FIG. 7 is a cross-sectional view taken along line VII—VII of FIG. 6.

As shown in FIG. 7, the timing plate 39 is swingably supported on a lower portion of the first rocker arm 31 by means of a pin 52. The pin 52 retains a torsion spring 53 thereon for normally urging the timing plate 39 to turn the same toward the piston 36. The rocker shaft 7 has a cam surface 54 defined on its outer periphery. An end of the timing plate 39 is kept in contact with the cam surface 54 under the bias of the spring 53.

The cam surface 54 is shaped to turn the timing plate 39 in response to swinging movement of the first rocker arm 31. More specifically, when the first rocker arm 31 is held at rest in sliding contact with the basecircle portion of the cam 34, the timing plate 39 is biased by the spring 53 to turn clockwise in FIG. 7 to engage in either of the grooves 48, 49. When the first rocker arm 31 is depressed by the cam 34 to open the intake valve 35, the timing plate 39 is turned counterclockwise away from the piston 36. Even when oil pressure is supplied to the hydraulic chamber 44, the presser 42 cannot be moved since the timing plate 39 engages in the groove 48. When the first rocker arm 31 starts swinging in the valve opening direction, the timing plate 39 is turned counterclockwise out of engagement with the piston 36, and the presser 42 is moved under oil pressure until it abuts against the end of the connector 41. When the first and second guide holes 40, 50 are subsequently registered axially with each other, i.e., the first rocker arm 31 is held at rest again, the connector 41 slides into the second guide hole 50 under oil pressure to interconnect the first and second rocker arms 31, 32. Upon completion of the connection of the rocker arms 31, 32 with the piston 36, the timing plate 39 engages in the groove 49.

When the oil pressure is released from the hydraulic chamber, the piston 36 is urged toward the first rocker arm 31 by the spring 38. However, inasmuch as the timing plate 39 engages in the groove 49, the piston 36 cannot immediately be moved. As the first rocker arm 31 is turned in the valve opening direction, the timing plate 39 is disengaged from the groove 49, whereupon the presser 42 can be displaced toward the hydraulic chamber 44. At this time, the connector 41 does not return into the first guide hole 40 due to frictional forces between itself and the walls of the first and second holes 40, 50 during swinging motion of the first rocker arm 31. The connector 41 can move back into the first guide hole 40 as soon as the first rocker arm 31 is held at rest.

The control means may be of any type insofar as it can control the timing of operation of the coupling device irrespective of the times at which energizing signals are issued.

Although a certain preferred embodiment has been shown and described, it should be understood that many changes and modifications may be made therein without departing from the scope of the appended claims.

What is claimed is:

1. A method of controlling a valve operating mechanism for an internal combustion engine having a crankshaft and a plurality of intake or exhaust valves normally biased in a valve closing direction, the valve operating mechanism including a cam rotatable in synchronism with said crankshaft, a plurality of movably mounted valve moving means operable by said cam to operate said valves, coupling means for selectively connecting and disconnecting adjacent ones of said valve moving means under hydraulic pressure, and a hydraulic circuit openable and closable according to a rotational speed of said engine for selectively supplying hydraulic pressure to said coupling means, said method comprising the steps of:

determining an engine operating condition requiring a change in engine valve operation and emitting a signal in response thereto, delaying transmission of said signal to the hydraulic circuit beyond a predetermined interval occurring between the instant of initial valve opening and an instant prior to the valve reaching its full open position; and thereafter transmitting said signal to said hydraulic circuit to actuate said coupling means.

2. A method according to claim 1, wherein said delay in transmission of said signal to said hydraulic circuit is dependent upon operating conditions of said internal combustion engine.

3. A method according to claim 1, wherein said valve moving means have first and second guide holes defined respectively therein, said coupling means including a piston slidably movable between said first and second guide holes for connecting and disconnecting said valve moving means, said predetermined initial interval being defined as that in which said piston, if urged to slidably move from said first guide hole into said second guide hole, would be struck by said valve moving means having said second guide hole.

4. A system for controlling a valve operating mechanism for an internal combustion engine having a crankshaft, a plurality of cylinders, and a plurality of intake or exhaust valves associated with each of said cylinders and normally biased in a valve closing direction, the valve operating mechanism having a cam rotatable in synchronism with said crankshaft, a plurality of movably mounted valve moving means operable by said cam to operate said valves, coupling means associated with each of said cylinders for selectively connecting and disconnecting adjacent ones of said valve moving means under hydraulic pressure, and a hydraulic circuit openable and closable according to a rotational speed of said engine for selectively supplying hydraulic pressure to said coupling means, said system comprising:

means for opening and closing said hydraulic circuit at fixed times dependent on the stroke of one of said cylinders; and control means operated in response to the operation of said one of the cylinders for controlling the timing of operation of the coupling means associated with said one cylinder in view of a delay in operation of said hydraulic circuit so that said coupling means will be inoperative when said rocker arms are in a predetermined initial interval of a valve opening stroke thereof.

5. A system according to claim 4, wherein said coupling means includes an axially expandable and contractable piston slidably movable in and between said rocker arms for selectively connecting and disconnecting said rocker arms, and spring means disposed in said piston for normally urging said piston in a direction to expand, said control means having a timing plate for controlling movement of said piston by selectively engaging and disengaging said piston.

6. A system according to claim 4, wherein said delay in operation of said hydraulic circuit is determined dependent on operating conditions of said internal combustion engine.

7. A system according to claim 4, wherein said valve moving means have first and second guide holes defined respectively therein, said coupling means including a piston slidably movable between said first and second guide holes for selectively connecting and disconnecting said valve moving means, said predetermined initial interval being defined such that when said piston is urged to slidably move from said first guide hole into said second guide hole during said initial interval, said piston is struck by said valve moving means having said second guide hole.

* * * * *